US007224276B2

(12) United States Patent
Matsudaira et al.

(10) Patent No.: US 7,224,276 B2
(45) Date of Patent: May 29, 2007

(54) ANTITHEFT SYSTEM

(75) Inventors: Shinji Matsudaira, Daito (JP); Hiroshi Yoshida, Sanda (JP)

(73) Assignee: Sensormatic Electronics Corporation, Boca Raton, FL (US)

( * ) Notice: Subject to any disclaimer, the term of this patent is extended or adjusted under 35 U.S.C. 154(b) by 19 days.

(21) Appl. No.: 10/475,565

(22) PCT Filed: Apr. 17, 2002

(86) PCT No.: PCT/JP02/03822

§ 371 (c)(1),
(2), (4) Date: Oct. 20, 2003

(87) PCT Pub. No.: WO02/086833

PCT Pub. Date: Oct. 31, 2002

(65) Prior Publication Data

US 2005/0099296 A1 May 12, 2005

(30) Foreign Application Priority Data

Apr. 20, 2001 (JP) ..... 2001-123204

(51) Int. Cl.
*G08B 13/14* (2006.01)

(52) U.S. Cl. ..... 340/572.1; 340/531; 340/572.4; 340/571; 340/522; 367/199

(58) Field of Classification Search ..... 340/572.1, 340/571, 531, 539, 572, 511, 507, 566; 367/197–199
See application file for complete search history.

(56) References Cited

U.S. PATENT DOCUMENTS

| | | | | |
|---|---|---|---|---|
| 4,417,235 | A * | 11/1983 | Del Grande | 340/531 |
| 4,520,503 | A * | 5/1985 | Kirst et al. | 381/56 |
| 4,897,862 | A * | 1/1990 | Nishihara et al. | 379/40 |
| 5,570,080 | A * | 10/1996 | Inoue et al. | 340/571 |
| 5,793,289 | A * | 8/1998 | Strzelec | 340/572.2 |
| 7,088,231 | B2 * | 8/2006 | Suzuka et al. | 340/531 |
| 2005/0030173 | A1 * | 2/2005 | Suzuka et al. | 340/531 |

* cited by examiner

*Primary Examiner*—Daniel Wu
*Assistant Examiner*—Travis R. Hunnings
(74) *Attorney, Agent, or Firm*—Frank Cona; Dean D. Small; Small Patent Law Group

(57) ABSTRACT

The present invention provides a burglar alarm system capable of accurately discriminating an alarm from a disturbance noise approximate to the alarm such as background music, ambient noises, etc. In a burglar alarm system comprising an alarm unit attached to an object to be protected from theft to emit an alarm of a particular frequency and an alarm sensor device for issuing an alarm signal upon sensing an alarm from the alarm unit, the alarm sensor device counts a predetermined number of waveform pulses of a received sound (S2, S5) more than once (S1~S3, S4~S6), determines, if it transpires that a differential between counted values falls within a predetermined time range, that the received sound is an alarm and issues an alarm signal (S7).

20 Claims, 4 Drawing Sheets

ANTITHEFT SYSTEM

CROSS REFERENCE TO RELATED APPLICATIONS

This application claims the benefit of Japanese Application No. 123204/2001 filed Apr. 20, 2001.

BACKGROUND OF THE INVENTION

1. Field of the Invention

The present invention relates to an anti-theft system intended to protect goods for sale from theft etc., and in particular to a burglar-alarm system utilizing an alarm to be emitted by an alarm unit attached to such goods.

2. Description of the Related Art

An anti-theft system such as that illustrated in FIG. 3 is commonly employed to prevent shop lifting, etc. at a retail store where compact disks, magnetic tapes, clothing garments, etc. are available to customers. The conventional anti-theft system consists of theft prevention gate 30 installed near exit 40 of the store and alarm unit 20 attached to article 50. The theft prevention gate 30 incorporates a circuit board 31 and transmitter antenna (not shown), and the circuit board 31 is provided with a transmitter circuit (not shown) which transmits an alarm activation signal to the alarm unit 20.

As shown in FIG. 4, the alarm unit 20 has a buzzer 22, a circuit board 23, a battery, etc. (not shown) each of which is housed in casing 21, and in the surface of which casing a plurality of alarm emitting holes 24 are provided and an alarm activation switch piece 25 is embedded. The buzzer 22, which is controlled by the circuit board 23, is designed to be activated when the alarm unit 20 is removed from the article 50 or passes through the theft prevention gate 30. As an alternative to providing the alarm unit 20 with the alarm activation switch piece 25, the alarm unit 20 may be attached directly to the article 50 by means of a wire, in which case when the alarm unit 20 senses that the wire has been removed or cut or passed through the theft prevention gate 30, the buzzer 22 is activated.

At a retail store, the article 50 with the alarm unit 20 affixed thereto is displayed on a rack. When a sales clerk sells the article 50 to a customer, he or she first sends a specified reset signal from an alarm deactivation device (not shown) to the circuit board 23 of the alarm unit 20 to set the alarm unit 20 such that the buzzer 22 will not be activated, then removes the alarm unit 20 from the article 50 and hands the article 50 to the customer when payment is made.

On the contrary, when the alarm unit 20 is removed from the article 50 by a customer, the alarm activation switch piece 25 becomes OFF and the buzzer 22 is activated. Further, in a case that a customer leaves a store premises taking away the article 50 with the alarm unit 20 still attached thereto, the circuit board 23 of the alarm unit 20 receives an alarm activation signal from the transmitter antenna of the theft prevention gate 30, in response to which the buzzer 22 is activated.

However, a checkout counter is usually at the back of a store, far away from the exit 40 of the store where the theft prevention gate 30 is installed and therefore, an alarm from the buzzer 22 that goes off at the exit 40 may not be readily audible from the checkout counter, especially in an environment where back ground music is present, or where many customers are present, etc.

With a view to solving the problem of the anti-theft device described above, a burglar alarm system such as illustrated in FIG. 5 is used as a supplementary device in which alarm sensor device 10 provided with microphone 11 is disposed near the theft prevention gate 30 so that the alarm sensor device 10 senses alarm 12 from the alarm unit 20 and issues alarm signal 13, which is sent through a wire or by wireless connection to a speaker 15 or lamp 16 disposed at a checkout counter 14 to alert store personnel at the checkout counter that the alarm has been activated.

Such a system as described above, however, suffers from a problem in that it may not be able to discriminate interference noise similar to that generated by an alarm, such as back ground music, ambient noise, etc. from an unrelated alarm.

Given the aforementioned problem, it is an object of the present invention to provide a burglar alarm system that can accurately sense an alarm.

It is another object of the present invention to provide a burglar alarm system provided with a function of adjusting the accuracy of determination.

BRIEF DESCRIPTION OF THE INVENTION

A burglar alarm system of the present invention comprises an alarm unit attached to an object to be protected from theft to emit an alarm of a particular frequency in response to wrongful conduct and an alarm sensor device for sensing an alarm from the alarm unit and generating an alarm signal, wherein said alarm sensor device counts a predetermined number of waveform pulses of received sound more than once and if it transpires that a differential between counted values falls within a predetermined time range, said received sound is regarded as an alarm and an alarm signal is issued.

Further, a burglar alarm system of the present invention comprises an alarm unit attached to an object to be protected from theft to emit an alarm of a particular frequency in response to wrongful conduct and an alarm sensor device for sensing an alarm from the alarm unit and generating an alarm signal, wherein an alarm from the alarm unit has an intermittent waveform of a constant cycle; and the alarm sensor device counts a predetermined number of waveform pulses of the alarm more than once while the alarm is continuing and if it transpires that a differential between counted values falls within a predetermined time range and that an intermittent cycle of the received sound matches an intermittent cycle of the alarm signal, it is determined that the received sound is a legitimate alarm and an alarm signal is issued.

Thus, the present invention can provide a burglar alarm system capable of accurately discriminating ambient noise approximate to an alarm such as back ground music, disturbance noises, etc. from an unrelated alarm.

In accordance with an embodiment of the present invention, a burglar alarm system has a function of adjusting a determination sensitivity level by determining more than once if a differential between counted values falls within a predetermined time range and if the aforementioned intermittent cycles match.

DETAILED DESCRIPTION OF THE INVENTION

Figure 1:
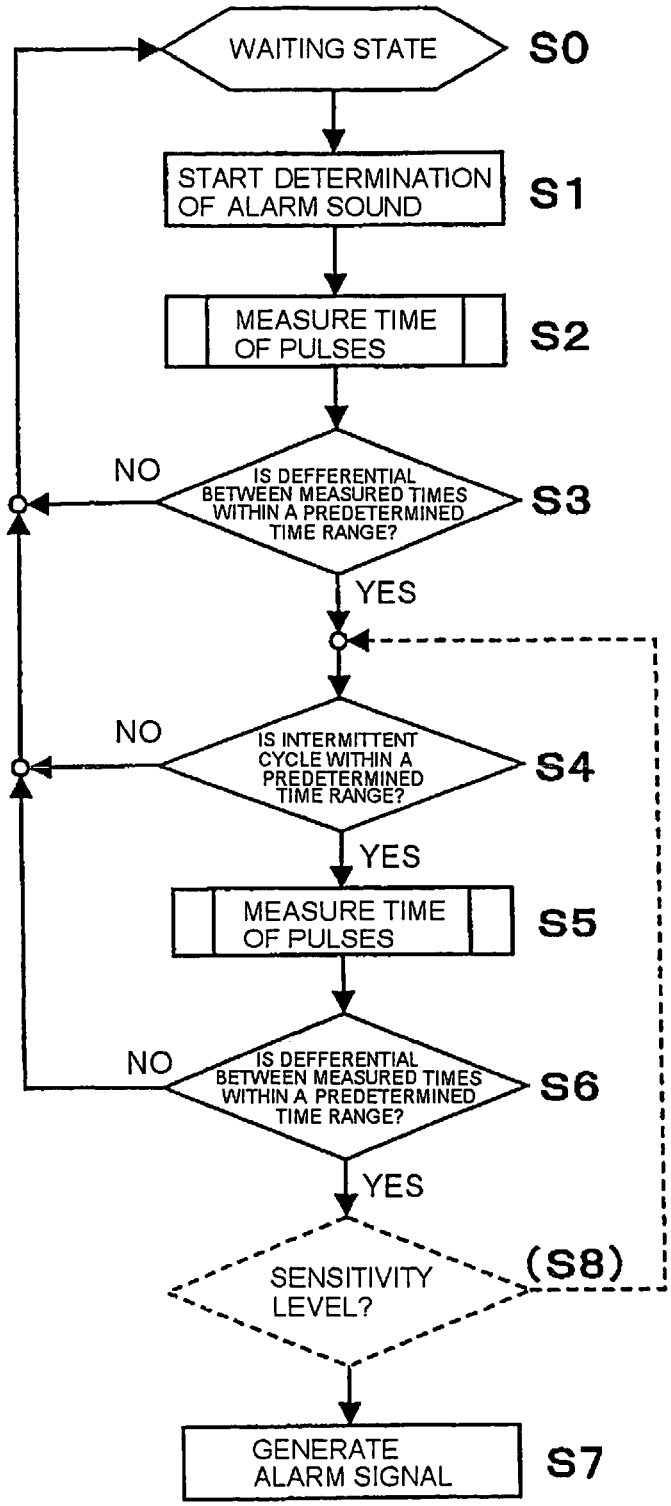
FIG. 1 is a flow chart representing an operation performed by an alarm sensor device in accordance with an embodiment of a burglar alarm system of the subject invention.
Figure 2:
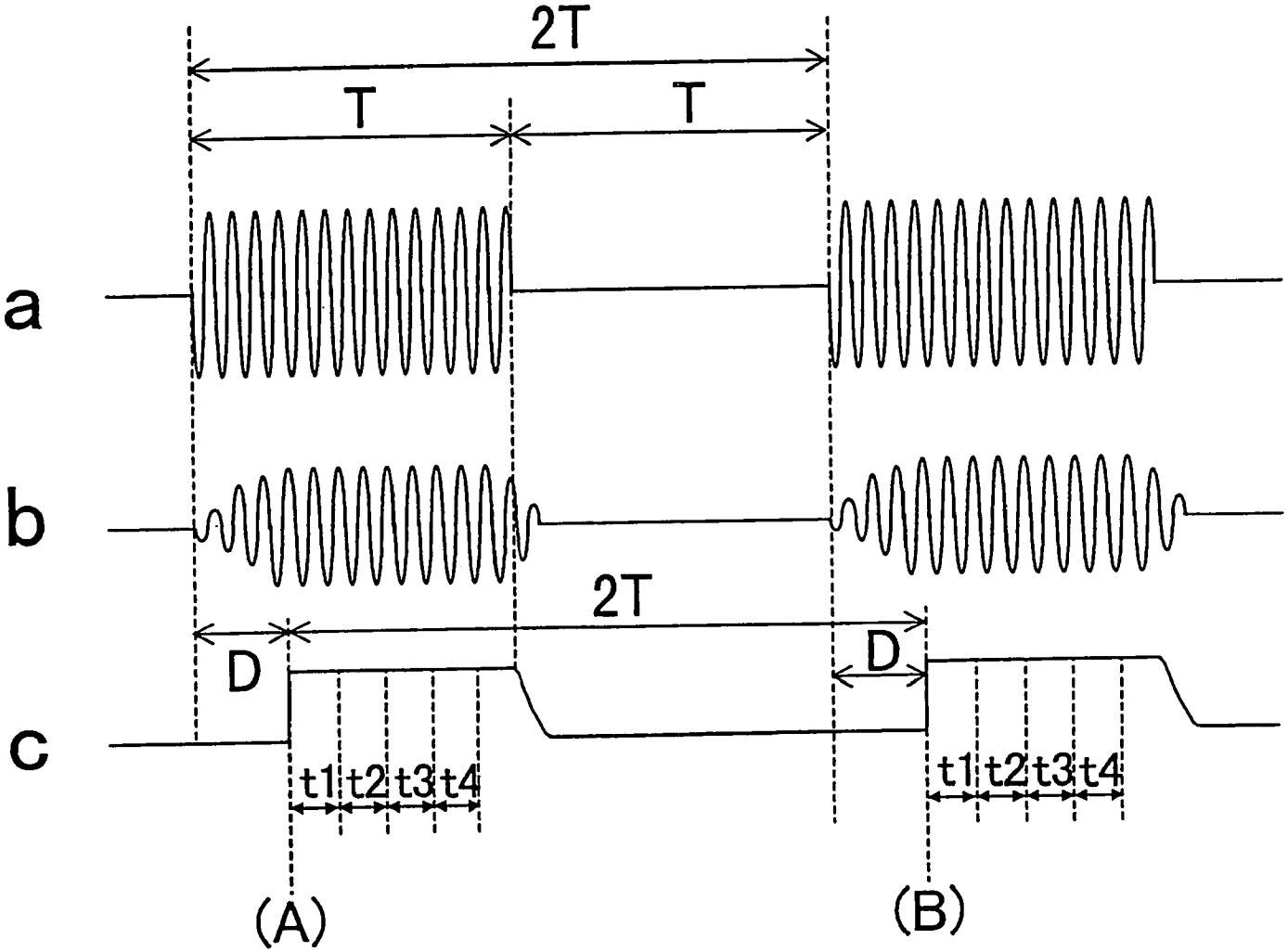
FIG. 2 shows signal waveforms of the subject embodiment.
Figure 3:
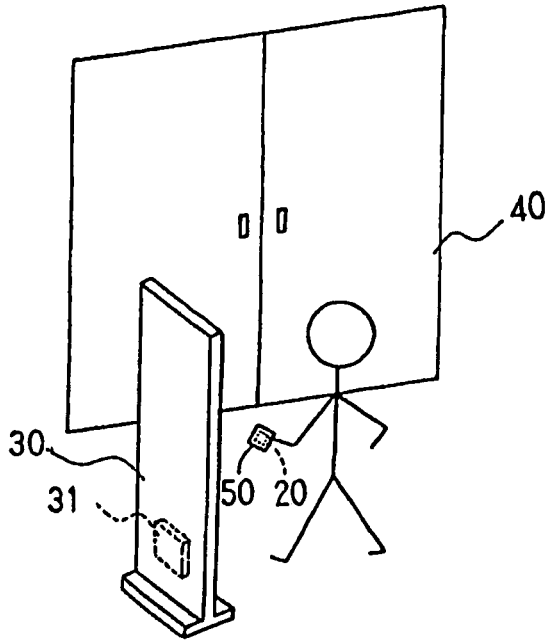
FIG. 3 is a model diagram of a burglar alarm system.
Figure 4:
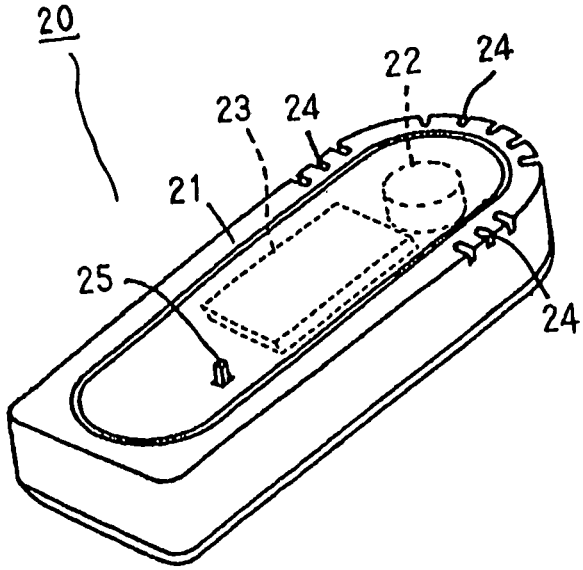
FIG. 4 is a perspective view of an alarm unit in the burglar alarm system.
Figure 5:
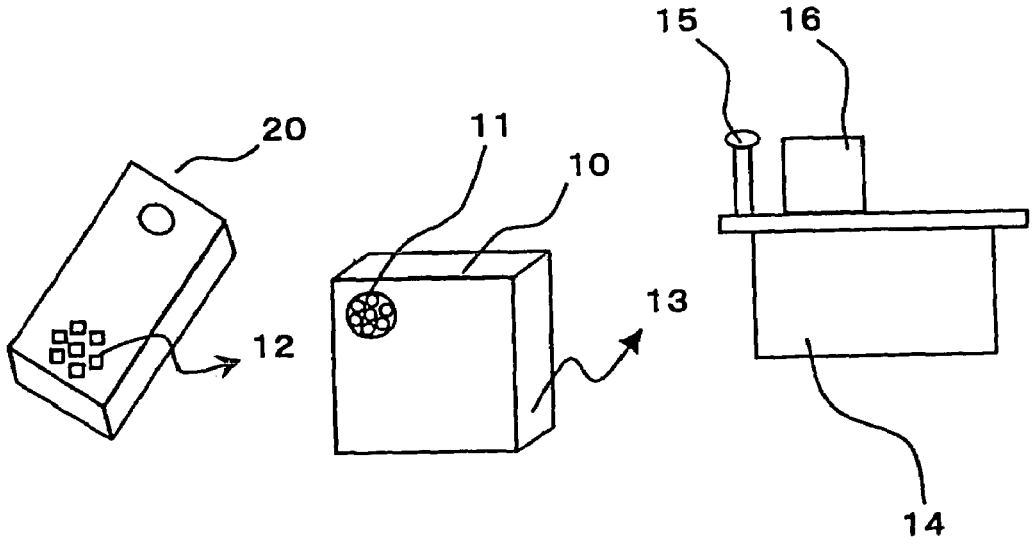
FIG. 5 is a model diagram of another burglar alarm system.

FIG. 1 is a flow chart representing an operation performed by an alarm sensor device of an embodiment of the present invention. FIG. 2 shows signal waveforms. Hereafter, the present invention will be specifically described with reference to the drawings.

As described above, in response to an unauthorized removal of an alarm unit from goods or a store, the alarm unit emits an alarm. The alarm is generated by a buzzer drive signal having an intermittent waveform of a particular frequency f (cycle: 2T, duty ratio: 50%) indicated in (a) of FIG. 2.

When a microphone of an alarm sensor device installed near a theft prevention gate or inside the premises of a store senses sound (received sound) having a frequency in the neighborhood of f, the alarm sensor device in the waiting state (S0) starts an alarm determination operation at step S1.

In such an alarm determination operation, as indicated in (b) of FIG. 2, a signal waveform of an alarm received by the alarm sensor device is unstable at a rise of a received signal because the signal has been subjected to signal processing such as amplification, transmission through a filter in the alarm sensor device, etc. Therefore, a determination operation is started at a rise (point A) of an envelope signal which rises later than the received signal by time D proportionate to filter characteristics and gradually falls at a fall of the received signal.

Once an alarm determination operation is started, the alarm unit measures a time for receiving a predetermined number of pulses (for example, 30 pulses) of the received signal more than once during the rise of the envelope signal (t1, t2, t3, t4).

At step S3, differentials between the respective measured time (t1–t2, t2–t3, t3–t4) are computed and if each differential falls within a predetermined time range (for example, ±10 μseconds), it is determined that the received signal is an alarm and the process proceeds to the next step S4. On the contrary, if any of the differentials does not fall within the predetermined time range, it is determined that the received signal is a disturbance noise or an ambient noise and the operation returns to the waiting state (S0).

At step S4, it is determined whether or not an interval between the determination operation start (point A) and the next rise (point B) of the envelope signal is not more than 2T (cycle of a buzzer drive signal)±d (for example, $\alpha$=10 m seconds). If it is not more than 2T±10 μseconds), it is determined that the received signal is an alarm and the operation goes to the next step S5. On the other hand, if an interval between the rises of the envelope signal is more than 2T±10 μseconds, it is determined that the received signal is a disturbance noise and the operation returns to the waiting state (S0).

At step S5, similarly to S2, a determination operation is started at the rise (point B) of the envelope signal and time for receiving a predetermined number of pulses (for example, 30 pulses) of the received signal is measured more than once during the rise of the envelope signal (t1, t2, t3, t4).

At step S6, similarly to S3, differentials between the respective measured receiving time (t1–t2, t2–t3, t3–t4) are computed and if each differential falls within a predetermined time range (for example, ±10 μseconds), it is determined that the received signal is an alarm and the operation goes to the next step S7. On the contrary, if any of the differential does not fall within the predetermined time range, it is determined that the received signal is a disturbance noise and the operation returns to the waiting state (S0).

At step S7, the alarm sensor device emits an alarm signal to alert store personnel by means of a speaker, lamp, etc. installed at a checkout counter by an alarm, through wire, by wireless, etc. that an alarm has been issued. Since an alarm signal may be stopped by a known method, i.e. turning off a switch, transmitting a stop signal, etc., it will not be described here how to stop an alarm signal.

As described above, according to the embodiment, utilizing the fact that an alarm emitted by the alarm unit has a particular frequency f while a disturbance noise does not have such a particular frequency and its frequency change is noticeable especially during a period when the number of pulses is a few dozen, a time for receiving a predetermined number of pulses is measured more than once to determine from a differential between measured time whether a received signal is an alarm or disturbance noise.

Further, according to the embodiment, an alarm from the alarm unit of the embodiment is designed to have an intermittent waveform so as to determine whether or not an intermittent cycle of a received signal matches an intermittent cycle of the alarm, whereby it can be more accurately determined whether a received signal is an alarm or a disturbance noise.

Still further, another step S8 (indicated by dashed lines in FIG. 1) may be added between the step S6 and the step S7 in the subject embodiment to adjust a determination sensitivity level of a sensor (for example, High=0, Middle=1, Low=2), which can be optionally set, so that the operations in the steps S4~S6 are repeated to adjust accuracy of determination. More specifically, for example, the operations in S4~S6 are performed once at the sensitivity level Middle while the operations are repeated twice at the sensitivity level Low, thereby improving accuracy in determination.

The subject inventions are in no way restricted by the disclosed embodiment and other modifications and variations will be apparent to persons skilled in the art. The present inventions are restricted only by the scope of claims of the present inventions.

The invention claimed is:

1. A method for detecting triggering of an alarm sensor, the method comprising:

measuring in a first envelope signal a first plurality of time periods during each of which a predetermined number of signal pulses are received;

comparing a duration of each of the first plurality of time periods;

determining if each of the durations for each of the first plurality of time periods are within a predetermined time range;

measuring in a second envelope signal a second plurality of time periods during each of which the predetermined number of pulses are received, if each of the determined durations for each of the first plurality of time periods are within the predetermined time range;

comparing a duration of each of the second plurality of time periods; and providing an alarm indication if each of the durations for each of the second plurality of time periods are within the predetermined time range.

2. A method according to claim 1 further comprising between measuring the first and second plurality of time periods, determining if a time interval between a start of measuring the first and second plurality of time periods is within a predetermined time range and measuring the second plurality of time periods if the time interval is within the predetermined time range.

3. A method according to claim 1 further comprising providing at least one of an audible and visible alarm in response to the alarm indication.

4. A method according to claim 1 further comprising starting the measuring of the first and second plurality of time periods after a predetermined delay period.

5. A method according to claim 1 further comprising starting the measuring of the first and second plurality of time periods at a rise of each of the first and second envelope signals.

6. A method according to claim 1 wherein the comparing is performed for each of the time periods.

7. A method according to claim 1 further comprising measuring additional pluralities of time periods based on a sensitivity level.

8. A method according to claim 1 further comprising using a microphone of an alarm sensor device to receive audible signals defining the signal pulses.

9. A method according to claim 1 further comprising determining if the received pulses are within a predetermined frequency range and measuring the first plurality of time periods if the received signal pulses are within the predetermined frequency range.

10. A method for detecting an alarm condition of an anti-theft system, the method comprising:

measuring after a predetermined time period a plurality of time periods during each of which a predetermined number of signal pulses are received;

comparing a duration of each of the plurality of time periods;

determining if each of the durations for each of the first plurality of time periods are within a predetermined time range; and providing an alarm indication if each of the durations for each of the plurality of time periods are within the predetermined time range.

11. A method according to claim 10 wherein the predetermined time period is defined by filter characteristics of an alarm sensing device of the anti-theft system.

12. A method according to claim 10 wherein the predetermined time period is defined by a duration between receiving the signal pulses and a start of a rise of an envelope signal.

13. A method according to claim 10 further comprising measuring additional pluralities of time periods based on a sensitivity level.

14. A method according to claim 10 further comprising starting the measuring of the plurality of time periods if the received signal pulses are within a predetermined frequency range defined by an intermittent waveform.

15. A method according to claim 10 further comprising receiving the signal pulses at a microphone of an alarm sensor device provided in connection with a theft prevention component of the anti-theft system.

16. An anti-theft system comprising:

an alarm unit configured to emit an alarm signal;

an alarm sensor device configured to:

detect signal pulses;

measure in a first envelope signal a first plurality of time periods during each of which a predetermined number of the signal pulses are received;

compare a duration of each of the first plurality of time periods;

determine if each of the durations for each of the first plurality of time periods are within a predetermined time range;

measure in a second envelope signal a second plurality of time periods during each of which the predetermined number of pulses are received if each of the determined durations for each of the first plurality of time periods are within the predetermined time range;

compare a duration of each of the second plurality of time periods; and provide an alarm indication if each of the durations for each of the second plurality of time periods are within the predetermined time range indicating that the signal pulses define an alarm signal emitted from the alarm device.

17. An anti-theft system according to claim 16 wherein the alarm sensor device comprises a microphone for receiving the signal pulses.

18. An anti-theft system according to claim 16 wherein the alarm sensor device is provided in proximity to a theft prevention component.

19. An anti-theft system according to claim 16 further comprising a connection between the alarm sensor device and a checkout area for communicating the alarm indication to the checkout area.

20. An anti-theft system according to claim 19 further comprising at least one of a speaker and lamp in proximity to the checkout area wherein an alarm signal is provided by at least one of the speaker and lamp in response to receiving the alarm indication via the connection.

* * * * *